United States Patent [19]

Farrar et al.

[11] Patent Number: 4,502,238

[45] Date of Patent: Mar. 5, 1985

[54] PUMP GUN FOREND

[75] Inventors: Jack R. Farrar, Whittier; Frank W. Farrar, Los Alamitos, both of Calif.

[73] Assignee: Pachmayr Gun Works, Inc., Los Angeles, Calif.

[21] Appl. No.: 438,531

[22] Filed: Nov. 1, 1982

[51] Int. Cl.[3] ..... F41C 23/00

[52] U.S. Cl. ..... 42/72; 42/71 R; 42/73

[58] Field of Search ..... 42/71 R, 72, 73

[56] References Cited

U.S. PATENT DOCUMENTS

| | | | |
|---|---|---|---|
| 2,104,129 | 1/1938 | Kress . | |
| 2,331,372 | 10/1943 | Buchanan . | |
| 2,547,180 | 4/1951 | Taylor | 42/72 |
| 2,771,697 | 11/1956 | Reising . | |
| 2,826,848 | 3/1958 | Davies | 42/71 R |
| 3,442,042 | 5/1969 | Gilbert . | |
| 4,328,633 | 5/1982 | Pachmayr et al. | 42/71 R |

FOREIGN PATENT DOCUMENTS 1067121 6/1954 France .

OTHER PUBLICATIONS

*NRA . . . Illustrated Firearms Assembly Handbook*, NRA, Washington, D.C., 1960, pp. 132–133.

Advertising Literature on Remington Model 870 Pump Shotguns.

*Primary Examiner*—Charles T. Jordan

*Assistant Examiner*—Ted L. Parr

*Attorney, Agent, or Firm*—William P. Green

[57] ABSTRACT

A pump gun having a forend element which is adapted to be reciprocated manually parallel to the barrel of the gun to feed successive rounds of ammunition to a firing location and cock the gun, with a handle connected to the forend element for reciprocation therewith and projecting generally transversely therefrom and therebeyond to facilitate cocking and holding of the gun. The handle may be mounted to swing between positions in which it projects in different directions from the forend element, and be releasably detented in any of those positions. The forend may have an outer surface formed of an elastomeric material for cushioning contact therewith.

13 Claims, 7 Drawing Figures

PUMP GUN FOREND

BACKGROUND OF THE INVENTION

This invention relates to improved pump type guns. A conventional 'pump' gun includes a forend element which is normally mounted at the underside of the gun barrel and is free to be manually reciprocated in a front to rear direction relative to the barrel to cock the gun and feed successive rounds of amunition to the firing chamber. The forend may be disposed about an elongated structure extending parallel to the barrel, with that structure usually functioning as a magazine tube for containing a series of shotgun shells or other rounds to be delivered rearwardly to the firing mechanism.

SUMMARY OF THE INVENTION

The present invention provides certain improvements in the forend structure for such a gun, serving to facilitate holding, cocking and other manipulation of the gun in use. As a first feature, a pump forend embodying the invention preferably is formed in part of rubber or other elastomeric material, presenting an outer resiliently deformable surface engageable by a user's hand in a relation cushioning manual contact with the forend. Another feature of the invention relates to the provision of a handle which is connected to the forend for pumping reciprocation therewith, and projects generally transversely of the forend to enable the forend and gun to be held and manipulated by this handle in a manner enhancing the overall control characteristics of the gun. The transversely projecting handle may be connected to the forend for movement between positions in which the handle projects in different directions from the forend, to enable the handle to be gripped at either the right side or left side of the forend or at its underside. The apparatus may include detenting means for yieldingly retaining the handle in any of its different positions while permitting actuation of the handle from one of those positions to another when desired.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figures 1, 2:
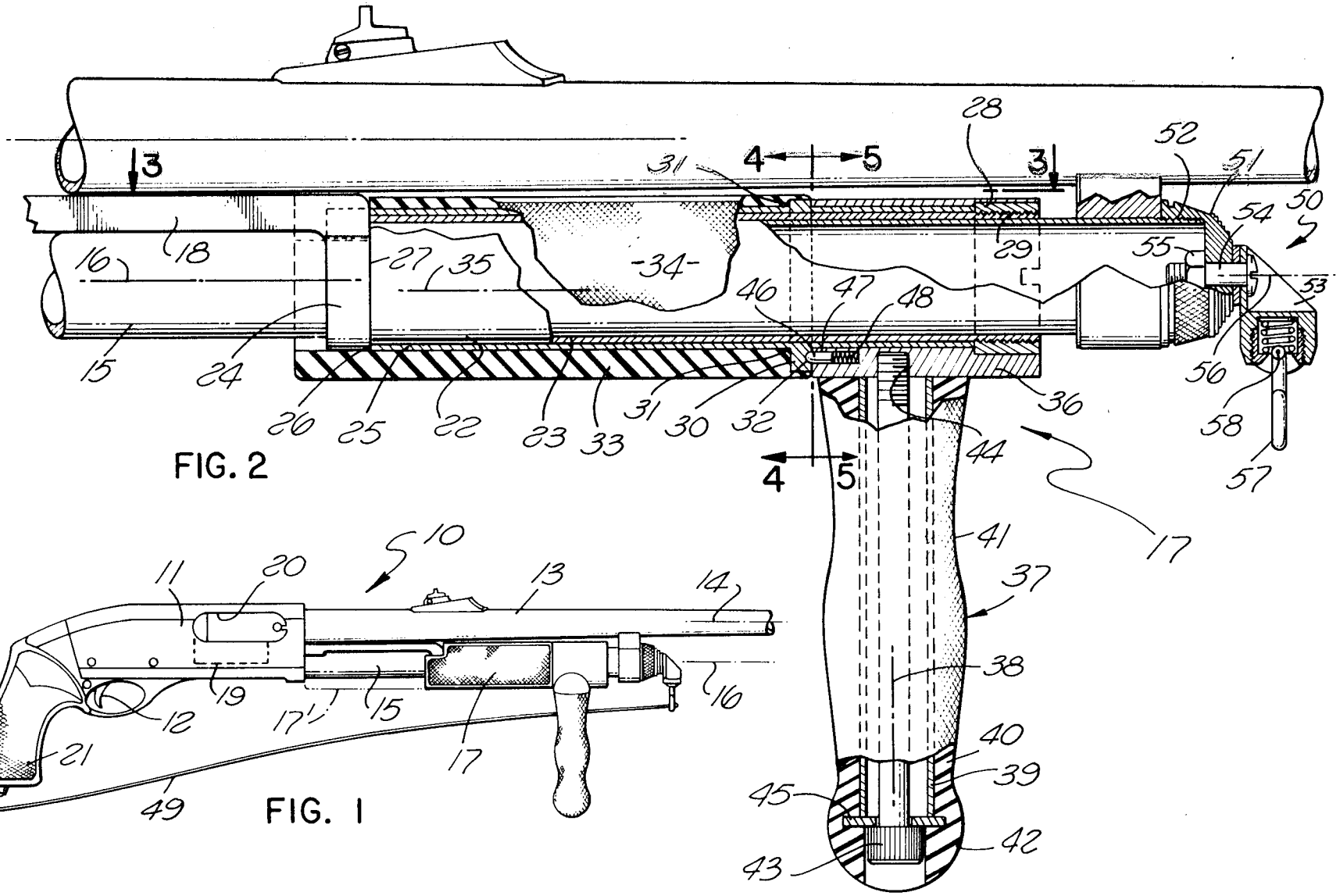
FIG. 1 is a side view of a pump shotgun having a forend assembly constructed in accordance with the invention.
FIG. 2 is an enlarged fragmentary view representing the forend assembly of FIG. 1, with the device illustrated partially in side elevation and partially in vertical section.
Figure 3:
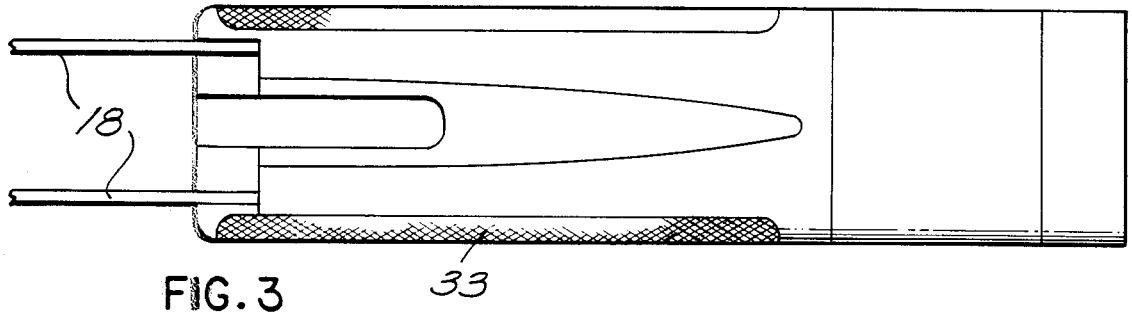
FIG. 3 is a plan view of the forend structure taken on line 3—3 of FIG. 2, with the barrel of the gun omitted for clarity of illustration.

Referring first to FIG. 1, there is illustrated at 10 in that figure a pump shotgun which may in most respects be of conventional construction, including the usual receiver 11 carrying firing mechanism actuable by a trigger 12 to fire a shotgun shell received in the rear portion of barrel 13, which is connected at its rear end to the receiver and projects forwardly therefrom along an axis 14. A magazine tube 15 extends along an axis 16 parallel to and directly beneath axis 14, and is adapted to contain a series of shotgun shells which are successively fed rearwardly from the tube 15 into the receiver for delivery to the barrel. A forend element 17 is disposed about tube 15 and is manually reciprocable along axis 16 relative to the tube between the full line forward position of FIG. 1 and the rear position represented in broken lines at 17'. Forend 17 is connected to two conventional parallel action bars 18 which extend rearwardly along the underside of the barrel parallel thereto into receiver 11 and function to actuate the firing mechanism 19 in a relation cocking it as a result of rearward movement of forend 17. The rearward and then forward reciprocation of the forend also functions to eject a spent shell from the receiver and the gun through a side opening 20, and to feed the next successive shell to the barrel, followed by automatic closure of the rear end of the barrel in preparation for firing of that shell by actuation of trigger 12. The gun may have either a conventional rearwardly projecting stock or a pistol type handle represented at 21.

To now describe the forend assembly in greater detail, that assembly may include a tube 22 which is internally and externally cylindrical and is a close fit on the outer cylindrical surface 23 of magazine tube 15 to guide tube 22 for the desired forward and rearward reciprocation along axis 16 about tube 15. At its rear end, tube 22 may be suitably connected to the action bars 18, as by providing a ring 24 brazed or otherwise rigidly secured to the outer surface of the tube at its rear end and formed integrally with or rigidly connected to the forward ends of bars 18 to actuate those bars in accordance with front to rear reciprocation of tube 22. Forend 17 may include a second internally and externally cylindrical rigid tube 25 which is a close fit on the outer surface of tube 22 and has a transverse annular rear end surface 26 engageable rearwardly against a forwardly facing transverse approximately annular front surface 27 on ring 24 to limit rearward movement of tube 25 on tube 22. A retaining ring 28 may be received about the forward end of tube 22 and threadedly connected thereto at 29 to clamp tube 25 rearwardly against shoulder 27 in a manner locking tube 25 in fixed position relative to tube 22.

Figure 4:
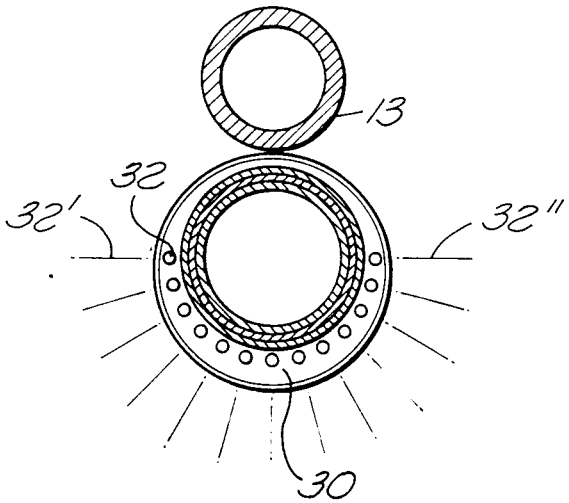
FIGS. 4 and 5 are transverse vertical sections taken on lines 4—4 and 5—5 respectively of FIG. 2.

At a location near its forward end, tube 25 may rigidly carry an approximately annular detenting ring 30 typically brazed to tube 25 at 31, and having a series of circularly spaced spherically curved concave detenting recesses 32 as represented in FIG. 4. These notches may be distributed along the entire lower half of ring 30, through 180 degrees from the location 32' in FIG. 4 to the location 32". To accomodate these recesses or notches, the lower half of ring 30 may have a greater radial dimension than the upper portion thereof, as shown.

Rearwardly of ring 30, the forend part 17 may include a body 33 of elastomeric material, preferably rubber typically having a Shore hardness between about 40 and 70 on the A scale. This body 33 is bonded internally to tube 25 to remain in fixed position relative thereto, and extends substantially entirely thereabout to form an outer sheath or tube having an external surface 34 which is resiliently deformable when contacted by a user's hand to cushion such contact. The outer surface 34 of the elastomeric material may be checkered or otherwise irregularized to enhance the frictional contact between a user's hand and that surface and thus further facilitate control, movement and positioning of the forend part by the user. Surface 34 except as thus irregularized may be essentially cylindrical about an axis 35 disposed parallel to and slightly beneath axis 16, with all of the axes 14, 16 and 35 preferably lying in a common vertical plane. The outer surface of ring 30 may also be centered about the mentioned axis 35.

Forwardly of ring 30, there is disposed about tube 25 another ring 36 which rigidly carries a handle 37 projecting generally transverse or laterally with respect to axis 16. Preferably, handle 37 extends along an axis 38 which intersects axis 16 and may be directly perpendicular thereto. The handle may include a rigid reinforcing tube 39 centered about axis 38 and carrying a body of elastomeric material 40 completely enclosing tube 39 and having an outer surface 41 engageable by a user's hand. The elastomeric material 40 may typically be of the same type of rubber utilized in forming the cushioning portion 33 of forend 17, and may project downwardly beneath the lower end of tube 39 at 42. A screw 43 may extend upwardly through the interior of the handle and be threadedly connected to ring 36 at 44 to secure the handle rigidly thereto, with the lower enlarged head of screw 43 engaging upwardly against an annular washer 45 embedded within and bonded to the elastomeric material 40 of handle 37 and acting upwardly against the lower end of tube 39 to clamp the tube between washer 45 and ring 36 and thus tightly retain the handle in fixed position relative to ring 36.

Figure 5:
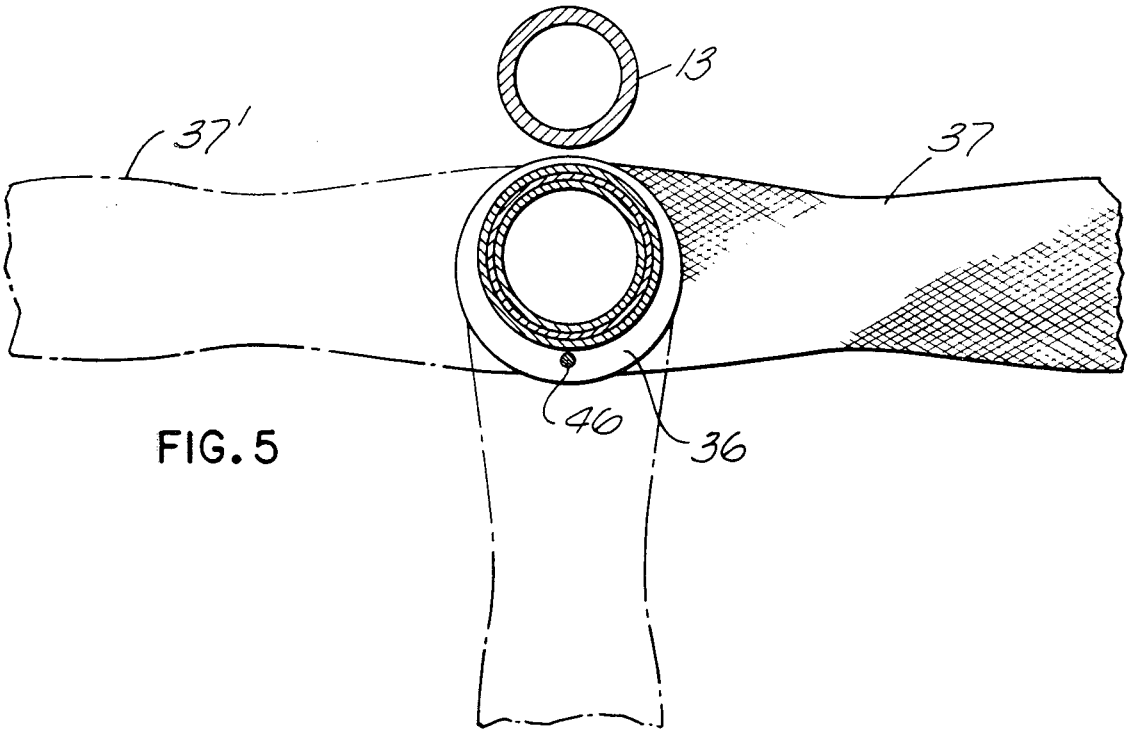

The handle and ring 36 may be turned about tube 25 through 180 degrees between the full line position of FIG. 5 and the oppositely directed broken line position prepresented at 37'. For lockingg the handle in either of these positions or any of a series of intermediate positions, ring 36 carries a detent pin 46 mounted within a recess 47 for movement parallel to axes 14, 16 and 35 under the influence of a spring 48. The rear end of pin 46 is hemispherically rounded, and is receivable selectively within any of the correspondingly hemispherical notches 32 in ring 36 in a relation releasably retaining the handle in any of the positions in which the pin is received in one of the notches. The notches are sufficiently shallow, however, to allow the handle to be forcibly moved between any of those different detenting positions, with the pin being cammed out of one notch by turning force exerted against handle 37 and then being spring returned into another of the notches when the handle reaches a desired newly set position. The mounting ring 36 of handle 37 is confined sufficiently closely between ring 28 and ring 30 to allow only rotary motion of handle 37 about axis 16 and retain the handle against axial movement.

The gun may be carried by a conventional sling strap 49, attached at its rear end to pistol handle 21. Desirably, the forward end of this sling is secured by a connector assembly 50 to the front end of magazine tube 15. For this purpose, a cap 51 extends across the forward end of tube 15 and is detachably connectable to the tube by internal threads in the cap engaging external threads on the tube at 52. A connector part 53 is secured to the center of the cap by a screw 54 extending through openings in connector 53 and the center of the cap and retained by a nut 55, with the head of the screw acting to retain part 53 against the cap while permitting rotation of part 53 relative to the cap about an axis 56. A sling swivel part 57 forms a loop through which the sling strap 49 extends in connectiong relation, with the part 57 being appropriately attached to connector 53, desirably in a manner allowing swinging movement of part 57 relative to part 53 about an axis 58.

In using the gun of FIGS. 1 through 5, a person may first load a series of shells into magazine tube 15 by inserting them forwardly into the magazine through the receiver. An initial one of the shells is then fed into the firing chamber and the gun is cocked by grasping forend 17 through contact with its cushioned elastomeric surface 34 and pumping that forend rearwardly from the full line position of FIG. 1 to the broken line position of that figure, followed by returning forward movement of the forend to its full line position. The gun is then ready to be fired. During such cocking and/or during the firing operation, a user may alternatively hold the forend and gun by grasping handle 37. This handle may be directed laterally in either direction to enable a user to hold it with either hand, or may be swung to and detented in any of the intermediate positions in which pin 46 is received within the various notches 32 in ring 30. The provision of handle 37 thus improves vastly the overall handling and firing characteristics of the gun.

Figure 6:
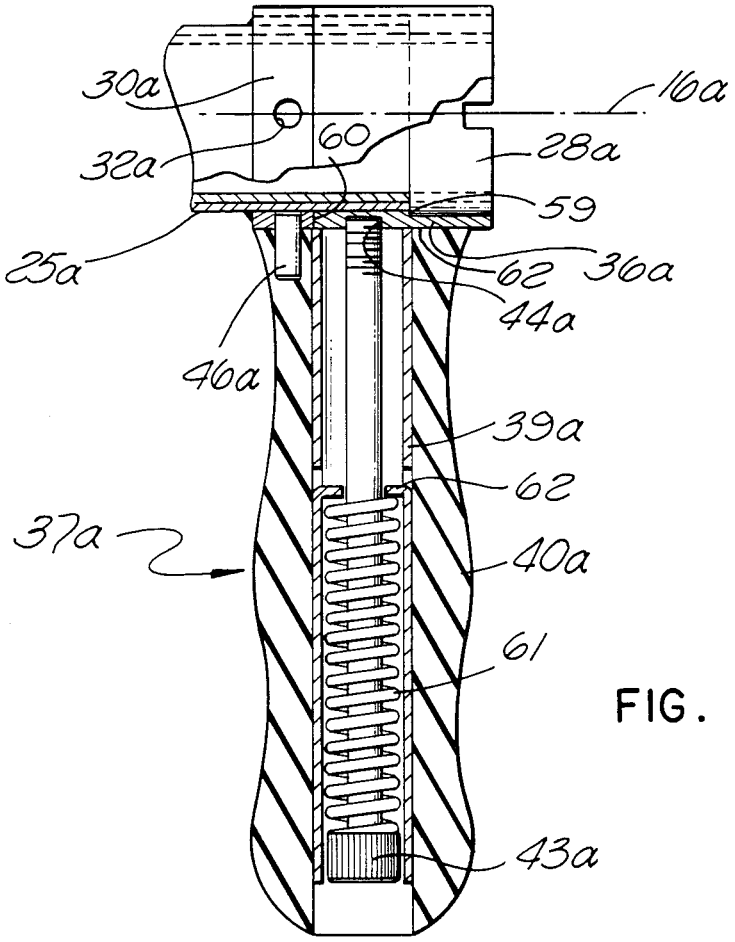
FIG. 6 is a view corresponding to a portion of FIG. 2 but representing a variational form of forend handle.

Referring now to FIG. 6, the variational form of handle **37*a* there illustrated includes a rigid reinforcing tube 39*a* of metal or other suitable material surrounded by a body of rubber or other elastomeric material 40*a* for cushioning contact of a user's hand with the handle. A screw 43*a* is connected threadedly at 44*a* into a ring 36*a* which is disposed about tube 25*a* and adapted to be rotated relative thereto about axis 16*a*. A detenting ring 30*a* is brazed to tube 25*a*, with a ring 28*a* corresponding to ring 28 of the first form of the invention acting to retain tube 25*a* on tube 22*a*. The ring 36*a* is confined at one end by engagement with a shoulder 59 on ring 28*a*, and at its other end by engagement with a transverse annular shoulder 60 on ring 30*a*, but with sufficient looseness to allow the desired rotation of ring 36*a*. A detenting pin 46*a* is carried by the elastomeric material 40*a* of handle 37*a*, and projects upwardly into any of several circularly spaced openings 32*a* formed in ring 30*a*, to releasably lock the handle in any of a series of different set positions. This detenting engagement can be released by downward movement of handle 37*a*, against resistance of a spring 61, which is confined between the enlarged head at the lower end of screw 43*a* and a plurality of tabs 62 formed by inturned material from the side wall of tube 39*a*. If the handle 37*a* is pulled downwardly against the resistance of spring 61, the portions 39*a* and 40*a* thereof separate from rings 30*a* and 36*a* at 62, thus withdrawing pin 46*a* from one of the openings 32*a* and permitting the handle to be turned about axis 16*a* relative to tube 22*a* to any of a series of different positions in which the handle projects either rightwardly or leftwardly from the gun or in any intermediate downwardly projecting position. The handle is retained in its new position by releasing it to permit pin 46*a* to move into a corresponding one of the openings 32*a***.

The gun constructed in accordance with FIG. 6 can be handled in essentially the same manner as discussed in connection with FIGS. 1 to 5, enabling a user to hold the gun by handle 37*a* received in either hand and in any desired relative setting with respect to the forend.

Figure 7:
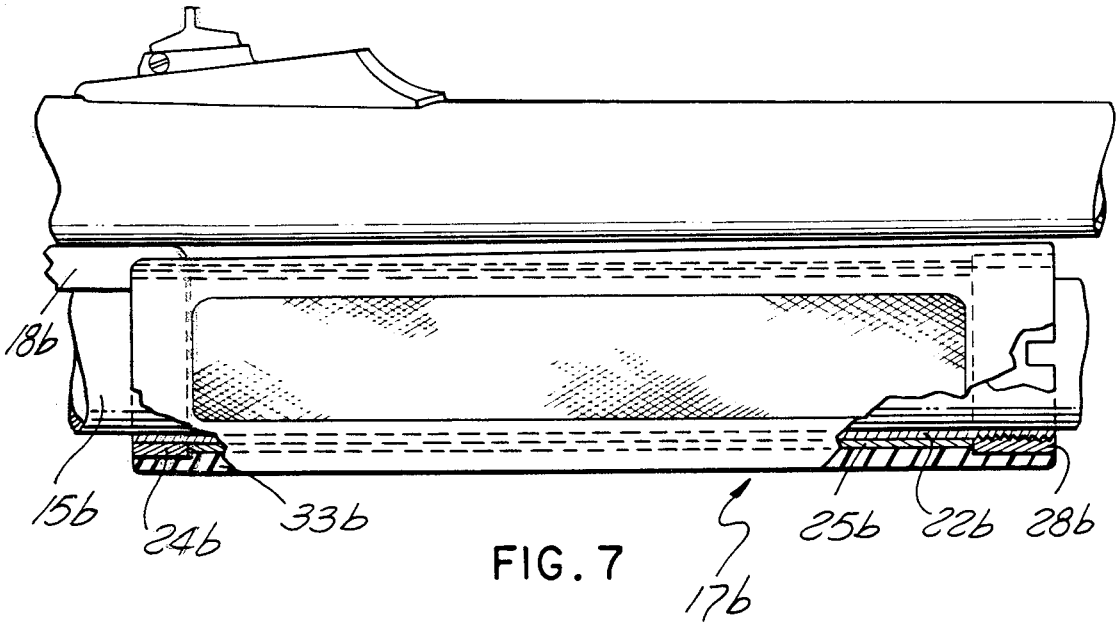
FIG. 7 is a side view, partially in axial section, of another form of the invention.

FIG. 7 illustrates another form of the invention in which the forend 17*b* is similar to unit 17 of the first form of the invention but without provision of the laterally projecting handle 37. Forend 17*b* in FIG. 7 is disposed about a magazine tube 15*b*, and acts by reciprocation in a front to rear direction relative thereto to actuate the ejecting, loading and cocking mechanism of the gun through movement of action bars 18*b*. The forend includes a first inner preferably metal tube 22*b* disposed about and fitting closely on magazine 15*b* and having a ring 24*b* at its rear end connected to action bars 18*b*. An additional tube 25*b* corresponding to element 25 of FIG. 2 carries a body of elastomeric material 33*b* similar to body 33 of FIG. 2, but with both of the elements 25*b* and 33*b* having greater axial extent than in the first form of the invention. A forward retaining ring 28*b* threadedly connected onto the forward end of tube 22*b* acts when tightened to clamp tube 25*b* and the carried elastomeric body 33*b* axially between ring 28*b* and ring 24*b*, to retain the parts in fixed relative position. The elastomeric body 33*b* may be thicker at the underside of the magazine than at its upper side, in correspondence with the eccentric relationship illustrated in FIG. 4, and the outer resiliently deformable essentially cylindrical surface of elastomeric body 33*b* may be checkered or otherwise irregularized.

In preparing the gun of FIG. 7 for firing, a user grasps the outer irregularized resiliently deformable surface of elastomeric forend body 33*b* and reciprocates the forend rapidly rearwardly and then forwardly as discussed in connection with the first form of the invention. The deformability of the surface of elastomeric body 33*b* cushions the contact between the user's hand and the gun, assists in absorbing recoil forces and the like without transmission to the hand, and in conjunction with the checkering of body 33*b* enhances the friction between the user's hand and forend in a manner increasing the effectiveness with which the user can control and operate the gun.

While certain specific embodiments of the present invention have been disclosed as typical, the invention is of course not limited to these particular forms, but rather is applicable broadly to all such variations as fall within the scope of the appended claims.

We claim:

1. An assembly for use with a pump gun having a barrel and having a magazine tube extending adjacent said barrel and essentially parallel thereto, said assembly comprising:

a pump forend adapted to be mounted about said magazine tube for manual reciprocation relative thereto essentially parallel to the barrel between forward and rear positions to prepare the gun for firing;

said forend having an outer surface to be gripped by a user's hand; and a handle connected to said forend for reciprocation therewith and projecting generally transversely therefrom beyond said outer surface of the forend;

said forend including a tubular body to be disposed about and reciprocate relative to said magazine tube and having a shoulder at its rear end and threads at its forward end, an additional tube received about said tubular body, a ring threadedly connected to said threads at the forward end of said body and adapted to clamp said additional tube against said shoulder to secure said additional tube thereto, an essentially annular body of elastomeric material carried about said additional tube and forming said outer surface of the forend for cushioned contact with a user's hand, a detecting ring secured to said additional tube and projecting radially outwardly therefrom, a third ring disposed about said additional tube forwardly of said detenting ring and carrying said handle and adapted to turn about said additional tube between positions in which said handle projects in different directions therefrom, and a spring pressed detenting element carried by one of said detenting and third rings and engageable with different coacting detenting notches in the other of said detenting and third rings to releasably retain said third ring and handle in any of said different positions thereof, said handle having an outer portion of elastomeric material forming a resiliently deformable outer surface engageable with a user's hand to cushion contact therewith.

2. An assembly as recited in claim 1, in which said handle and third ring are free to turn relative to said additional tube through at least about 180 degrees.

3. An assembly as recited in claim 1, including a screw extending through a passage in said handle and threadedly connectible to said second ring to secure the handle thereto.

4. An assembly as recited in claim 1, in which said tubular body and said additional tube are centered about a first axis, and said outer surface of the forend formed on said body of elastomeric material is generally cylindrical about a second axis offset from said first axis to be eccentric with respect to said first axis, said elastomeric material being thicker radially at the underside of said additional tube than at its upper side.

5. An assembly as recited in claim 1, in which said third ring and handle rotate about a first axis relative to said additional tube, and said third ring has an outer surface centered about a second axis offset from said first axis.

6. An assembly as recited in claim 1, in which said tubular body and said additional tube are centered about a first axis, and said outer surface of the forend formed on said body of elastomeric material is generally cylindrical about a second axis offset from said first axis to be eccentric with respect to said first axis, said elastomeric body being thicker radially at the underside of said additional tube than at its upper side, said third ring being mounted by said additional tube to turn about said first axis, said third ring having an eccentric outer surface centered about said second axis and essentially aligned with said outer surface formed on said elastomeric body, said detenting ring and said third ring being thicker beneath said additional tube than above it, said detent element being carried by said third ring at the underside of said additional tube.

7. The combination comprising an assembly as recited in claim 6, and a pump gun having a barrel and a magazine tube about which said forend of said assembly is mounted.

8. The combination comprising an assembly as recited in claim 1, and a pump gun having a barrel and a magazine tube about which said forend of said assembly is mounted.

9. An assembly for use with a pump gun having a barrel and having a magazine tube extending adjacent said barrel and essentially parallel thereto, said assembly comprising:

a tubular pump forend member adapted to be mounted about said magazine tube for manual reciprocation relative thereto along an axis and essentially parallel to the barrel between forward and rear positions to prepare the gun for firing, and having a shoulder at its rear end and threads at its forward end;

an additional tube received about said tubular member;

a body of elastomeric material carried about said additional tube and having an outer resiliently deformable surface to be gripped by a user's hand;

a first ring disposed about said tubular member forwardly of said elastomeric body and which is mounted to turn about said axis relative to said tubular member;

a handle carried by said ring to turn therewith and projecting outwardly away from said axis beyond said outer surface of said elastomeric body; and a retaining ring connected to said threads at the forward end of said tubular member at a location confining both said additional tube and said first ring axially between said shoulder and said retaining ring and blocking forward removal of said additional tube and first ring from said tubular member.

10. An assembly as recited in claim 9, in which said additional tube has a flange projecting radially outwardly near the forward end of said elastomeric body and has a reduced diameter portion forwardly of said flange about which said first ring is received.

11. An assembly as recited in claim 10, including means connecting said handle to said ring for limited movement radially outwardly relative thereto, spring means yieldingly urging said handle radially inwardly, and coacting detent elements on said flange and said handle interengageable to retain said handle against rotary movement and releasable by radially outward movement of the handle.

12. An assembly as recited in claim 9, including detent means for releasably retaining said first ring and handle in any of different positions in which the handle projects in different directions.

13. An assembly as recited in claim 9, including means connecting said handle to said first ring for movement relative thereto, and detent means which retain said first ring in any of different positions in which the handle projects in different directions, said detent means being releasable by movement of said handle relative to said first ring.

* * * * *